United States Patent [19]

Weil

[11] Patent Number: 4,939,501

[45] Date of Patent: Jul. 3, 1990

[54] SLIDING FOOT CONTROLLER

[76] Inventor: Robert P. Weil, 22416 Ocean Ave., #213, Torrance, Calif. 90505

[21] Appl. No.: 408,282

[22] Filed: Sep. 18, 1989

[51] Int. Cl.[5] ..... H01C 10/00

[52] U.S. Cl. ..... 338/153; 84/741; 338/160

[58] Field of Search ..... 338/153, 157, 158, 160, 338/161, 176; 84/711, 741; 74/478, 512

[56] References Cited

U.S. PATENT DOCUMENTS 3,151,307 9/1964 Marrs ..... 338/158

4,251,796 2/1981 Soeda et al. ..... 338/176

*Primary Examiner*—C. L. Albritton

*Attorney, Agent, or Firm*—Roger A. Marrs

[57] ABSTRACT

A foot-operated controller is disclosed herein having a housing enclosing an elongated resistive element carried on the underside of a top panel midway between its opposite sides. The top panel is provided with a slot slidably accommodating an electrical contact in slidable engagement with the resistive element. A foot-engaging treadle is disposed on the top panel from which the electrical contact downwardly depends so as to travel therewith as the treadle moves. The treadle is provided wheeled support riding in a grooved track carried on a bottom panel of the housing. Stops are provided on the opposite ends of the grooves to limit linear movement of the treadle and electrical leads and plugs are included.

2 Claims, 1 Drawing Sheet

SLIDING FOOT CONTROLLER

BACKGROUND OF THE INVENTION

1. Field of the Invention

The present invention relates to the field of electrical controllers and more particularly to a novel sliding controller operated by the foot of the user for varying the resistance of a resistance element in order to adjust the volume of an electronic amplifier, loudspeaker of the like.

2. Brief Description of the Prior Art

In the past, it has been the conventional practice to adjust the volume of an amplifier used in a musical system by employing a pivotal switch or controller that varies the electrical output in accordance with an inverse proportional control. That is, as a person's foot is pressed against a pivoting lever, the resistance is changed so that the voltage output is inversely proportional to the position of the lever. Because of the angular displacement of the lever, more travel is required at the opposite ends of the control as opposed to the mid-section or central portion thereof. Therefore, a musician using such a control for his amplifier does not have the advantage of a linear response along the full length of a resistor, potentiometer or the like.

Therefore, problems and difficulties have been encountered by a musician in properly adjusting the voltage for his amplifier so that it is in a linear response to the music he is playing. The sensitivity of the foot control is therefore adversely affected and is not in a true proportion to the eminating sound from loudspeakers or the like.

Therefore, there has been a long-standing need to provide a foot control for supplying amplifiers or the like with a voltage that is in direct linear proportion to the advance or retraction of a sliding member used in the potentiometer. Although rotary switches and potentiometers have been provided, such output and control is not foot-operated. It is desirable to provide a foot-operated switch which is directly proportional in its output to the linear displacement of the foot element being moved at the direction and selection of the user.

SUMMARY OF THE INVENTION

Accordingly, the above problems and difficulties are obviated by the present invention which provides a novel foot controller having a housing which supports a sliding treadle having a downwardly depending electrical contact that engages with a linear resistive element carried within the housing. A slot is provided in the top panel of the housing for accommodating the sliding movement of the electrical contact as the treadle is moved between the opposite ends of the slot. In order to accommodate easy sliding, the treadle is provided with wheels that ride in shaped grooves carried on the bottom panel of the housing and stop means are provided for limiting the extent of movement of the treadle between the opposite ends of the grooves. Electrical sockets are provided on the housing as well as electrical leads which extend between the sockets and the resistive element.

Therefore, it is among the primary objects of the present invention to provide a novel foot controller for use in an electrical amplifying circuit which includes a foot treadle operatively engaged with a linear resistor for adjusting the voltage output in accordance with movement of the user's foot.

Another object of the present invention is to provide a novel foot controller employing a sliding treadle which functions in combination with a linear resistive element for selectively adjusting the voltage output in accordance with movement of the user's foot.

Yet another object of the present invention is to provide an electronic foot controller which is easy to manufacture and use and which employs a relatively few number of parts to accomplish its intended purpose.

BRIEF DESCRIPTION OF THE DRAWINGS

The features of the present invention which are believed to be novel are set forth with paricularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
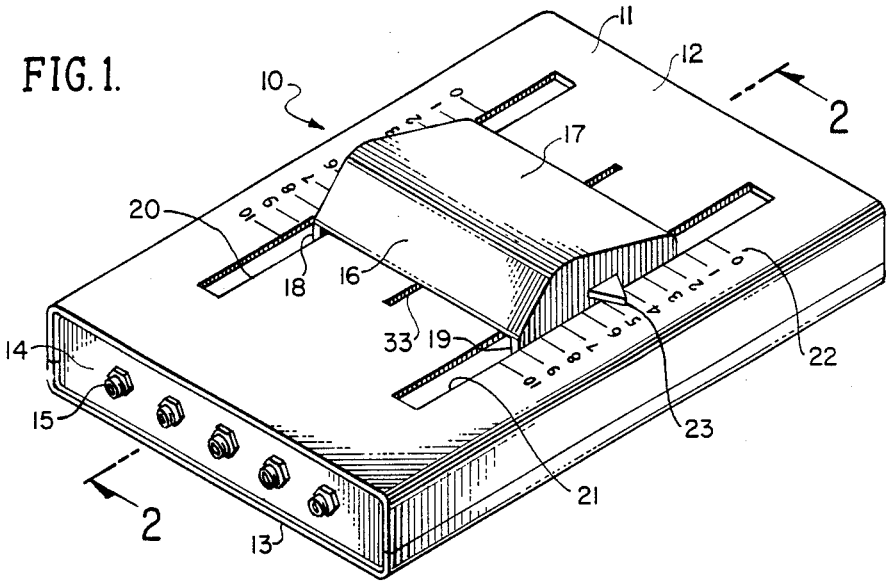
FIG. 1 is a front perspective view showing the novel foot controller of the present invention.

Referring to FIG. 1, the novel foot controller of the present invention is indicated in the general direction of arrow 10 which includes a box-like housing 11 having a top panel 12 and a bottom panel 13. One end of the housing includes a socket panel 14 onto which a plurality of sockets, such as socket 15, are carried. The respective sockets are intended to receive mating plugs which are detachably connected thereto and lead usually to electronic equipment such as an amplifier. Moveably mounted on housing 11 and adapted to move along the top panel 12, there is provided foot treadle 16 which includes a sloping ramp 17 adapted to receive the sole of the user's foot. The treadle is intended to be moved along the top panel 12 adjacent to its exterior or exposed surface and the treadle 17 includes downwardly depending legs 18 and 19 which project through elongated slots 20 and 21, which hold the treadle 17 away from the top surface of panel 12 in spaced-apart relationship so that it will not scrape or bind while being moved across the housing.

FIG. 1 also indicates that indicia, such as a numerical scale, may be carried on the surface of panel 12 adjacent to the slots 20 and 21. Such an arrangement of indicia is broadly indicated by numeral 22 adjacent to slot 21. The indicia, such as the numbers, are preferably arranged in fixed spaced-apart relationship of equal distance along the length of the scale and an indicator 23 carried on each side of the treadle 17 is used as a pointer to be associated with given indicia of the scale 22.

Figure 2:
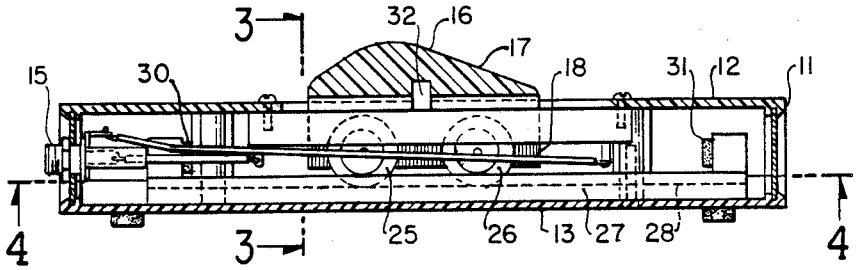
FIG. 2 is a longitudinal cross-sectional view of the foot controller shown in FIG. 1 as taken in the direction of arrows 2—2 thereof.

Referring now in detail to FIG. 2, it can be seen that each of the respective elements 18 and 19 extends into the inner compartment of the housing 11 and each of the respective elements carries a set of wheels, such as indicated by numerals 25 and 26, associated with element 18. The wheels are in alignment as carried on each element and ride in a groove on a rail 27. The groove is broadly indicated by numeral 28 and is open at the top in order to rollably receive the respective wheels. It is to be understood that the rail 27 is duplicated on the opposite side of the housing so as to accommodate the wheels carried by element 19. In order to limit movement of the treadle 16, padded stops 30 and 31 are provided at opposite ends of the housing in direct alignment with the rails 27. Also, it is to be observed that the treadle 16 further includes a downwardly depending electrical supported contact which is identified by numeral 32, and the contact extends through an elongated slot 33 disposed midway between the slots 20 and 21.

Figure 3:
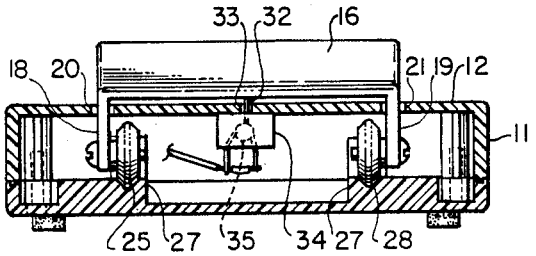
FIG. 3 is a transverse cross-sectional view of the foot controller taken in the direction of arrows 3—3 of FIG. 2.

In FIG. 3, it can be seen that immediately beneath the slot 33, there is provided an electrical component 34 comprising a linear resistive element 35 upon which the contact 32 slides in response to movement of the treadle 16.

Figure 4:
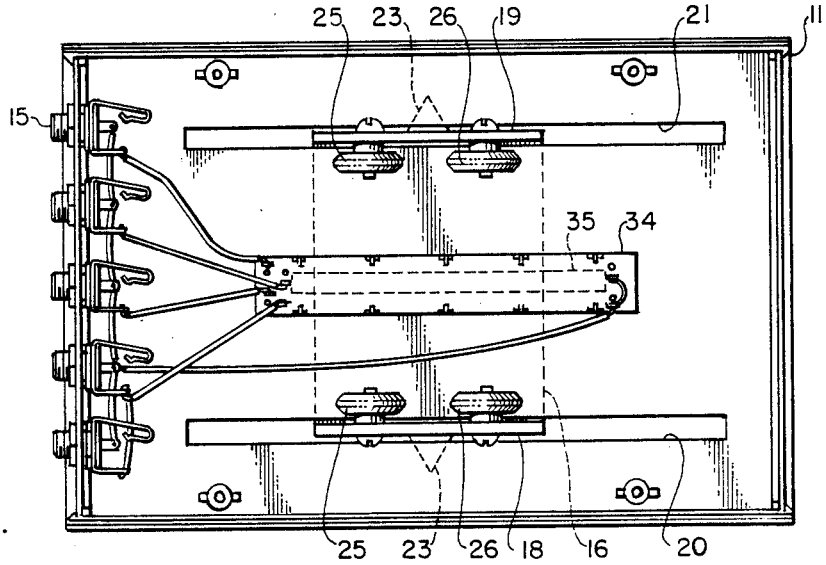
FIG. 4 is a plane view of the controller showing the internal components thereof as taken in the direction of arrows 4—4 of FIG. 2.

In FIG. 4, it can be seen that the resistive eletrical component 34 is disposed between the leg elements 18 and 19 on the treadle 16 midway between the slots 20 and 21. In view of the foregoing, it can be seen that the treadle may be moved along the central longitudinal axis of the housing and that its electrical contact will slide along the resistive element so as to change the output voltage which is then used to modulate or control an amplifier and an output loudspeaker. The control is linear and completely proportional, and such a feature is visually displayed by the scale and pointer relationship.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A foot controller for sliding an electrical contact along a linear resistive element, the combination comprising:

a rectangular housing enclosing a component compartment defined between a top panel and a bottom panel; p1 an elongated central slot provided in said top panel communicating with said component compartment;

a foot treadle movably disposed on said housing adjacent to said top panel adapted to be moved rectilinearly across said top panel slot between the opposite ends of said housing;

a linear resistive element carried in said component compartment under said top panel;

an electrical contact secured to said treadle and downwardly projecting through said elongated slot into operative contact with said resistive element;

means cooperatively carried on said housing and said treadle to rollably support said treadle on said housing;

said rollable support means includes a pair of rails fixed on said housing bottom panel in spaced-apart relationship; and wheel sets downwardly depending from said treadle in rollable contact with rails.

2. The invention as defined in claim 1 including:

a pair of slots in said top panel separated by said central slot for accommodating wheel support elements attached to said treadle.

* * * * *